US009394645B2

(12) United States Patent
Park et al.

(10) Patent No.: US 9,394,645 B2
(45) Date of Patent: Jul. 19, 2016

(54) LID HINGE HAVING PISTON AND CAM MEMBERS FOR A LAUNDRY TREATMENT MACHINE

(71) Applicant: LG ELECTRONICS INC., Seoul (KR)

(72) Inventors: Youngbae Park, Changwon-si (KR); Yongjun An, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 141 days.

(21) Appl. No.: 14/063,275

(22) Filed: Oct. 25, 2013

(65) Prior Publication Data

US 2014/0116097 A1 May 1, 2014

(30) Foreign Application Priority Data

Oct. 25, 2012 (KR) ..... 10-2012-0119175
Oct. 25, 2012 (KR) ..... 10-2012-0119177

(51) Int. Cl.
*D06F 39/14* (2006.01)

(52) U.S. Cl.
CPC ..... *D06F 39/14* (2013.01)

(58) Field of Classification Search
CPC ..... D06F 37/18; D06F 39/14; D06F 37/28; D06F 37/42; D06F 37/10; A47L 15/4261
USPC ..... 68/196
See application file for complete search history.

(56) References Cited

U.S. PATENT DOCUMENTS 4,787,121 A 11/1988 Racenis et al. ..... 16/356
5,109,571 A 5/1992 Ohshima et al. ..... 16/307
7,117,562 B2 10/2006 Zuo et al. ..... 16/303
7,337,498 B2 3/2008 Hsieh ..... 16/330
7,418,279 B2 8/2008 Tkagi ..... 455/575.1
7,818,845 B2 10/2010 Hu et al. ..... 16/330
8,336,167 B2 12/2012 Kim ..... 16/303
8,432,677 B2 4/2013 Duan et al. ..... 361/679.27

(Continued)

FOREIGN PATENT DOCUMENTS

CN 1284601 A 2/2001
CN 1699898 A 11/2005

(Continued)

OTHER PUBLICATIONS

Korean Office Action issued in application No. 10-2012-0119175 dated Dec. 24, 2014.

(Continued)

*Primary Examiner* — Michael Barr
*Assistant Examiner* — Rita Adhlakha
(74) *Attorney, Agent, or Firm* — Ked & Associates, LLP

(57) ABSTRACT

Provided is a laundry treatment machine. The laundry treatment machine may include a main body, a lid, and at least one hinge that supports the lid. The hinge may include a hinge housing filled with a fluid having a prescribed viscosity, an elastic member disposed inside the hinge housing, and a pair of cams disposed in the housing to move in linkage with the lid and the elastic member. A piston may be disposed between the moving cam and the elastic member to deform the elastic member according to a displacement of the moving cam. The piston may divide a cavity inside the hinge housing into a first space in which the elastic member is disposed and a second space in which the pair of cams are disposed. The piston may include a passage for the fluid to flow between the first space and the second space.

20 Claims, 13 Drawing Sheets

(56) References Cited

U.S. PATENT DOCUMENTS

| | | | | |
|---|---|---|---|---|
| 8,444,234 | B2 | 5/2013 | Kim et al. | 312/228 |
| 8,511,115 | B2 * | 8/2013 | Kim | D06F 39/14 16/225 |
| 8,683,653 | B2 * | 4/2014 | Bettinzoli | E05F 1/1261 16/286 |
| 8,763,431 | B2 | 7/2014 | Kim et al. | 68/3 R |
| 2005/0258724 | A1 * | 11/2005 | Hwa Kim | E05F 3/10 312/405 |
| 2008/0128156 | A1 | 6/2008 | Kuwajima et al. | 174/161 R |
| 2010/0162526 | A1 | 7/2010 | Duan et al. | 16/303 |
| 2010/0275413 | A1 | 11/2010 | Kim | 16/303 |
| 2011/0050059 | A1 | 3/2011 | Kim et al. | 312/228 |
| 2011/0050060 | A1 | 3/2011 | Kim et al. | 312/228 |
| 2011/0062837 | A1 * | 3/2011 | Kim et al. | 312/228 |
| 2011/0089793 | A1 | 4/2011 | Kim et al. | 312/228 |

FOREIGN PATENT DOCUMENTS

| | | | |
|---|---|---|---|
| CN | 101988253 | A | 3/2011 |
| JP | 2005-023950 | A | 1/2005 |
| KR | 10-2002-0030620 | A | 4/2002 |
| KR | 10-2009-0100154 | A | 9/2009 |

OTHER PUBLICATIONS

U.S. Office Action issued in co-pending U.S. Appl. No. 14/063,249 dated Aug. 18, 2014.

Chinese Office Action issued in Application No. 201310512791.1 dated Jun. 3, 2015.

Korean Office Action issued in Application No. 10-2012-0119175 dated Jun. 8, 2015.

* cited by examiner

LID HINGE HAVING PISTON AND CAM MEMBERS FOR A LAUNDRY TREATMENT MACHINE

CROSS-REFERENCE TO RELATED APPLICATION(S)

This application claims priority under 35 U.S.C. §119 to Korean Application No. 10-2012-0119175, filed on Oct. 25, 2012, and No. 10-2012-0119177, filed on Oct. 25, 2012, whose entire disclosures are hereby incorporated by reference.

BACKGROUND

1. Field

The present disclosure relates to a laundry treatment machine.

2. Background

Generally, laundry treatment machines refer to various apparatuses that treat laundry by applying physical and chemical actions to laundry. Examples of laundry treatment machines include a washing machine that separates contaminants from clothing and bedding (hereinafter, referred to as laundry) using chemical decomposition of water and detergent and mechanical action such as friction between water and laundry, a drying machine that dehydrates and dries wet laundry, and a refresher that sprays heated vapor to laundry to unwrinkle or sterilize laundry.

These laundry treatment machines include a main body in which laundry is treated and a lid or a door pivotably coupled to the main body to open and close a laundry loading hole. In this case, when the lid is closed, the lid may strongly hit the main body, affecting the durability of a product. Also, since the lid is formed of a metallic material or includes a glass to form a lid window, the weight of the lid increases. For these reasons, a large force is needed for a user to open the lid, and when the lid is closed, the lid may strongly hit the main body.

In a typical laundry treatment machine, the lid is pivotably supported by hinges disposed at both sides of the lid, and one of two hinges provides a certain repulsive force or a resistant force to serve as a shock-absorbing member that controls the pivoting speed of the lid during the pivoting of the lid. However, since the repulsive forces or the resistant forces provided from both hinges are not uniform, there is a limitation of distortion of the lid.

Particularly, one of typical two hinges includes an elastic member that is deformed during the pivoting of the lid, and provides a torque in a direction where the lid is opened by a restoring force of the elastic member when the lid is pivotably closed, decelerating the closing speed of the lid. The other hinge includes a wing rotating in linkage with the lid in a fluid, serving as a damper that performs a damping action by a hydraulic pressure or a viscous force acting between the wing and the fluid. However, this structure has a limitation in that an unbalance of forces occurs between the hinges due to a structural difference of both hinges and thus the lid is deformed.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

In the drawings.

DETAILED DESCRIPTION

The advantages and features of the present disclosure and the way of attaining them will become apparent with reference to embodiments described below in detail in conjunction with the accompanying drawings. Embodiments, however, may be embodied in many different forms and should not be constructed as being limited to example embodiments set forth herein. Rather, these example embodiments are provided so that this disclosure will be through and complete and will fully convey the scope to those skilled in the art. The scope of the present disclosure should be defined by the claims. Wherever possible, the same reference numbers will be used throughout the drawings to refer to the same or like parts.

Hereinafter, a laundry treatment machine according to an embodiment of the present disclosure will be exemplified as a washing machine, but the scope of the present disclosure is not limited thereto. Therefore, it should be noted that the present disclosure can also be applied to laundry treatment machines such as drying machines, washing & drying machines, and refreshers.

Figure 1:
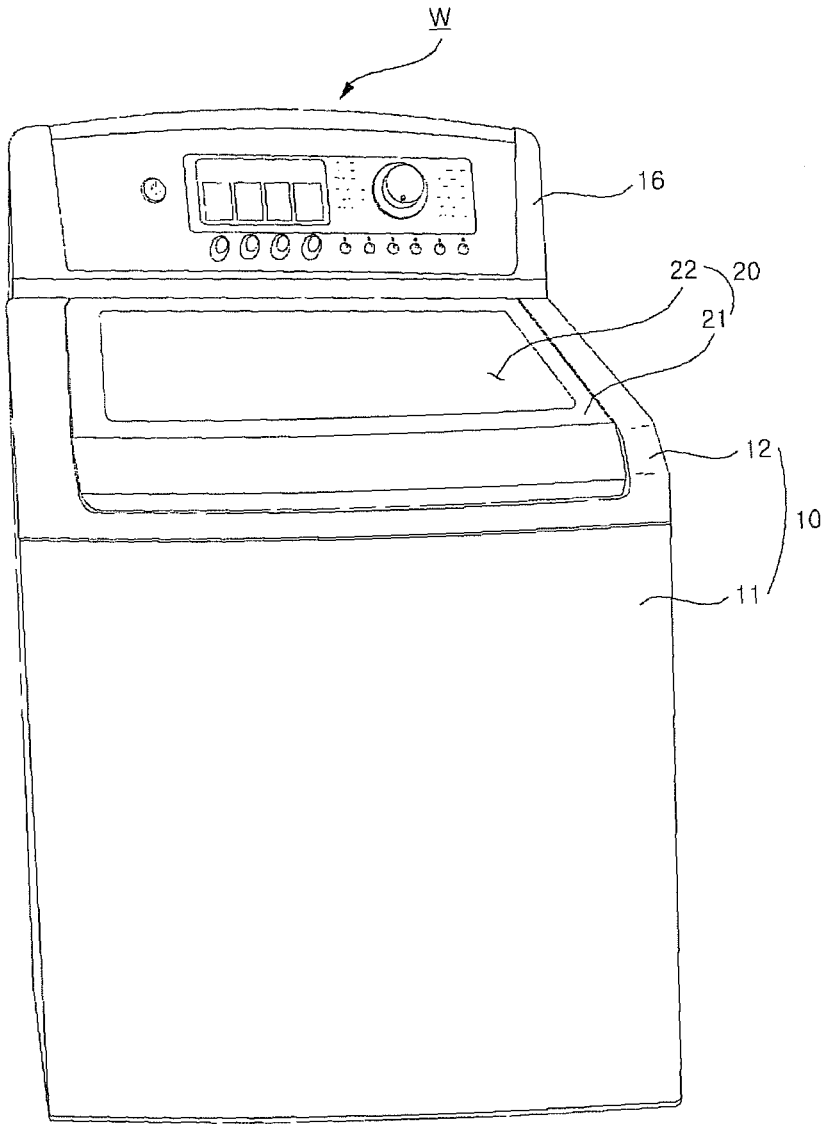
FIG. 1 is a perspective view illustrating a washing machine according to an embodiment of the present disclosure.
Figure 2:
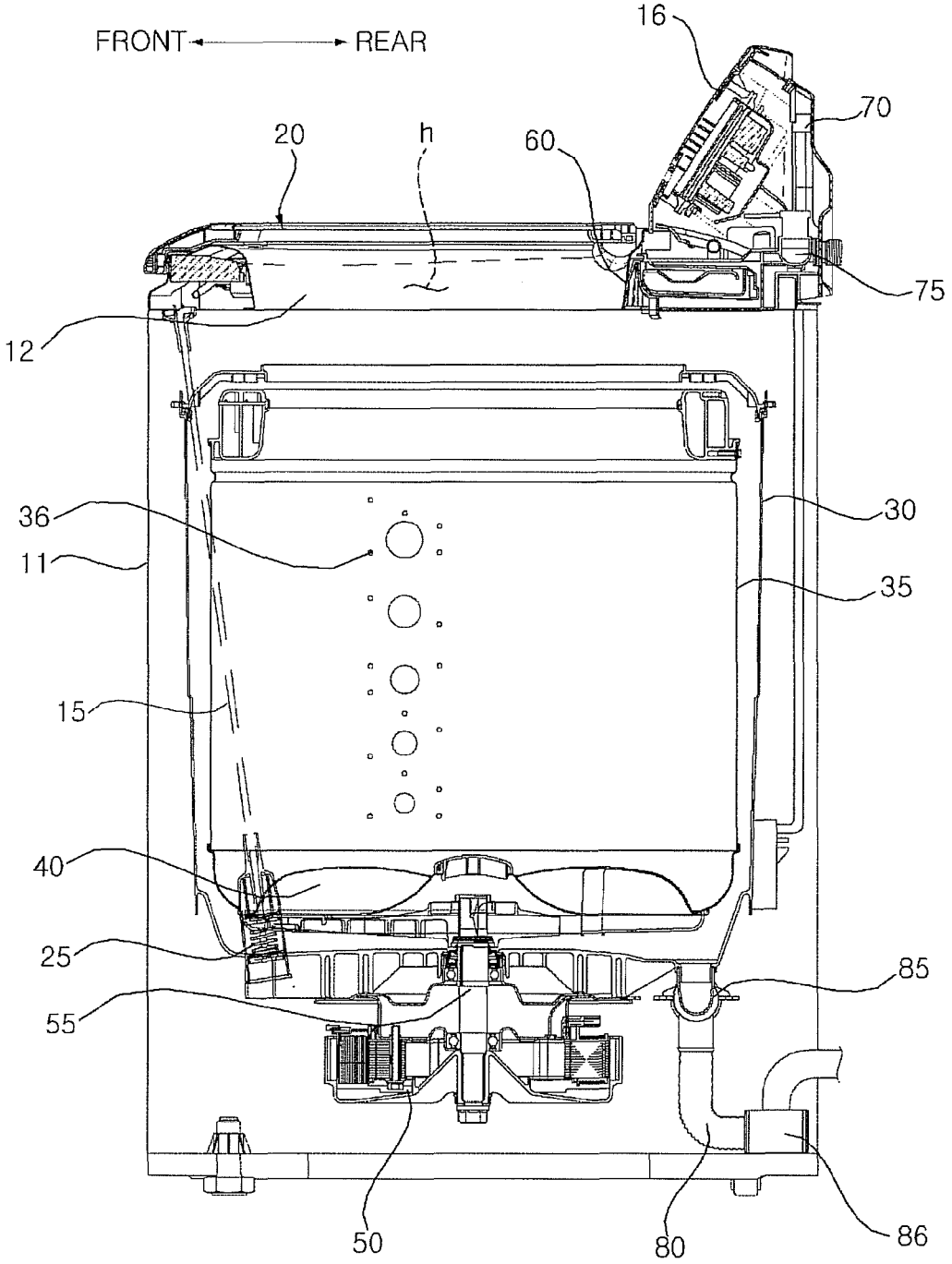
FIG. 2 is a side cross-sectional view illustrating the inside of the washing machine of FIG. 1.
Figure 3:
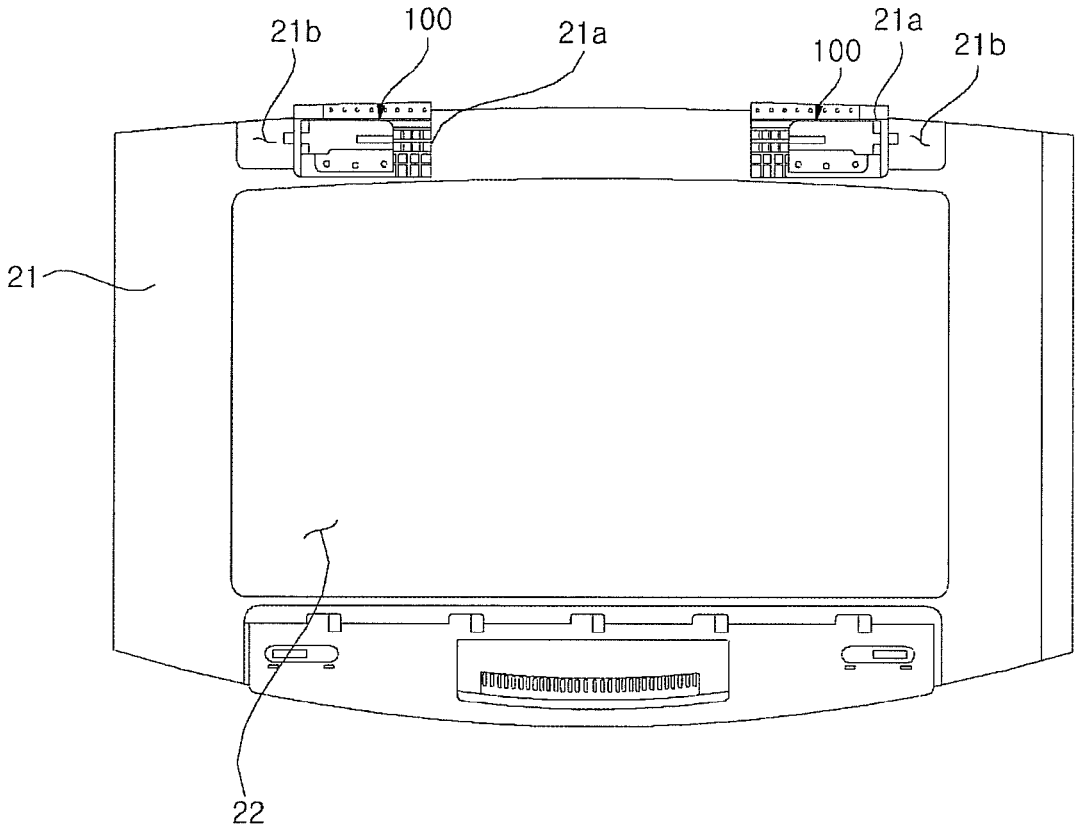
FIG. 3 is a view illustrating a coupling relationship of a lid and a hinge part of FIG. 1.

FIG. 1 is a perspective view illustrating a washing machine according to an embodiment of the present disclosure. FIG. 2 is a side cross-sectional view illustrating the inside of the washing machine of FIG. 1. FIG. 3 is a view illustrating a coupling relationship of a lid and a hinge part of FIG. 1.

Referring to FIGS. 1 and 2, a washing machine W may include a main body 10 and a lid 20 pivotably disposed at the main body 10. The main body 10 may include a cabinet 11 having an upper portion opened and a top cover 12 having a laundry loading hole h through which laundry is loaded into and unloaded from the cabinet 11. In this case, the lid 20 may be supported by the top cover 12, and may open and close the laundry loading hole h.

A control panel 16 may include an input unit for receiving various control commands for the operation of the washing machine W and a display unit for displaying the operation state of the washing machine W.

An outer tub 30 may be suspended in the cabinet by a support member 15, and may hold wash water. An inner tub 35 may be rotatably disposed inside the outer tub 30. A damper 25 may be disposed at the lower end of the support member 15 to absorb the shaking of the outer tub 30 due to the vibration generated during the rotation of the inner tub 35. Contaminants of laundry may be effectively removed by a frictional action between a pulsator 40 and wash water contained in the inner tub 35 and whirling water generated by the rotation of the pulsator 40.

The inner tub 35 may have a plurality of water holes 36 such that wash water can flow between the inner tub 35 and the outer tub 30. A motor 50 may be disposed under the outer tub 30 to rotate the pulsator 40. The inner tub 35 and/or the pulsator 40 may be rotated by a shaft 55 of the motor 50.

A clutch (not shown) that connects the shaft 55 to the inner tub 35 and/or pulsator 40 may be provided to rotate both or either of the inner tub 35 and the pulsator 40. The inner tub 35 and the pulsator 40 may rotate at the same time or only the pulsator 40 may rotate according to the operation of the clutch.

A detergent box 60 may be withdrawably provided to the top cover 12 to contain detergent, and a water supply hose 70 for supplying wash water connected to an external water source such as a household faucet and a water supply valve 75 for controlling wash water flowing through the water supply hose 70 may be provided to the top cover 12. When the water supply valve 75 is opened to supply wash water from the external water source, wash water supplied may flow into the detergent box 60, and then may be mixed with detergent contained the detergent box 60 to be supplied into the inner tub 35.

A water exhaust hose 80 may be provide at the lower end of the outer tub 30 to discharge wash water out of the outer tub 30, and a water exhaust control valve 85 may be provided to control wash water discharged through the water exhaust hose 80. Also, a drain pump 86 may be provided to pump wash other to the outside.

The lid 20 may be pivotably coupled to the top cover 12 such that a user can open and close the laundry loading hole h. In this case, in order for a user to easily open the lid 20, when the lid 20 is in a closed state, the front end portion of the lid 20 may protrude compared to the top cover 12.

Referring to FIG. 3, the lid 20 may include a lid frame 21 and a lid window 22 supported by the lid frame 21. The lid frame 21 may be formed of a synthetic resin through injection molding, and the lid window 22 may be formed of a transparent member such as tempered glass Since the lid window 22 having a stiffness stronger than the lid frame 21 is provided at the central portion of the lid frame 21, the structural stability can be improved, and thus a distortion of the lid frame 21 can be prevented.

Figure 4A:
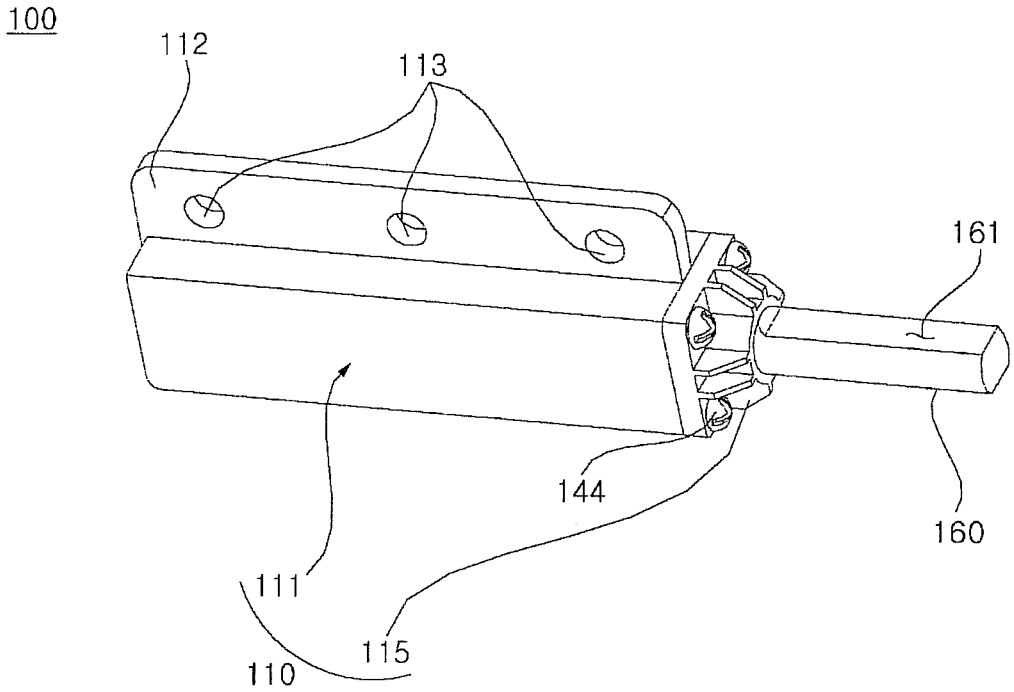
FIG. 4A is a perspective view of a hinge part.
Figure 4B:
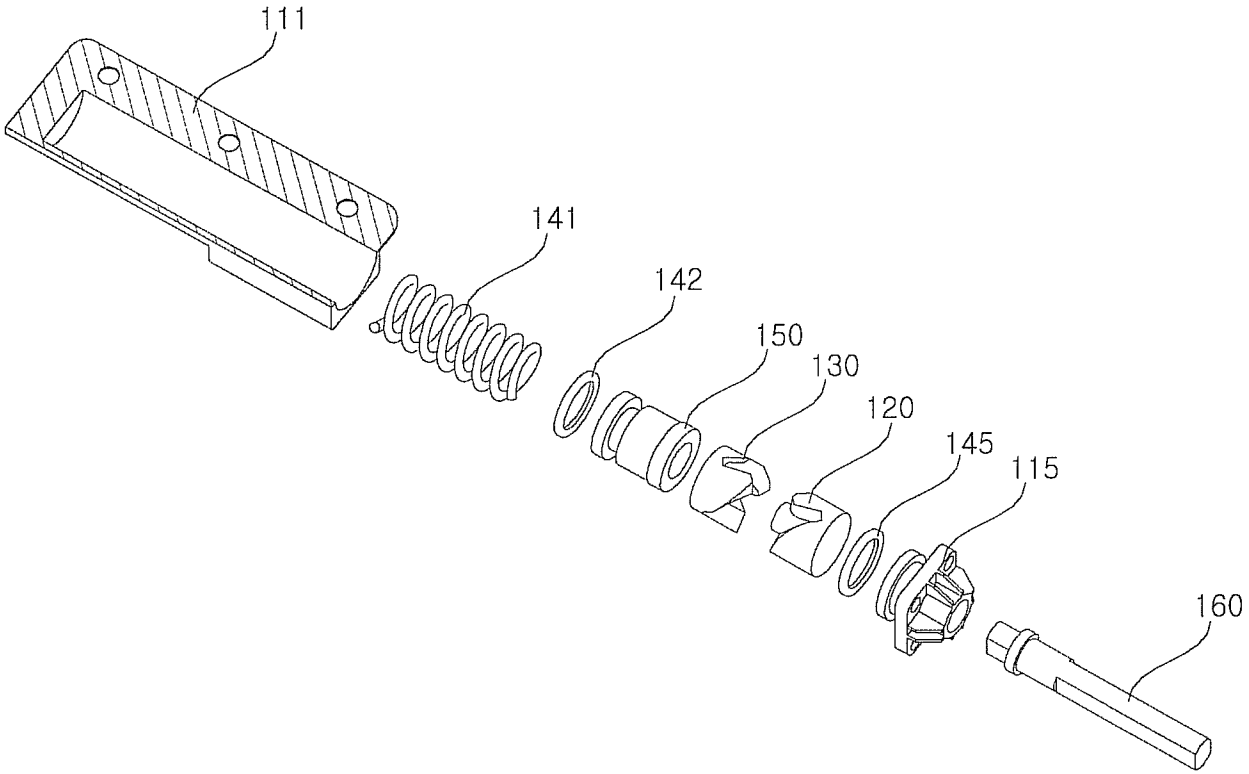
FIG. 4B is an exploded perspective view of the hinge part.
Figure 4C:
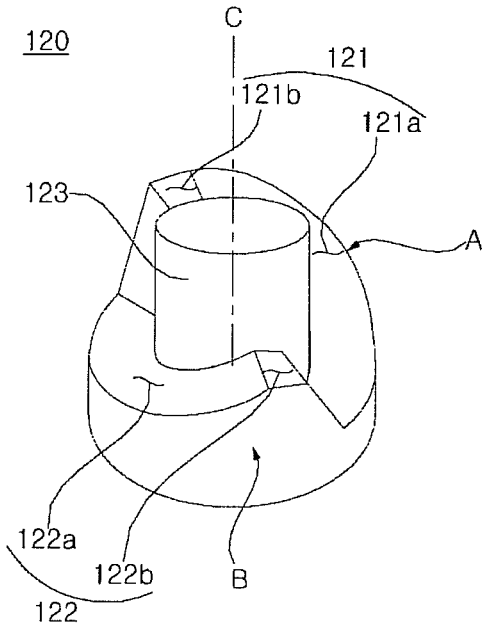
FIG. 4C is a view of a fixing cam.
Figure 4D:
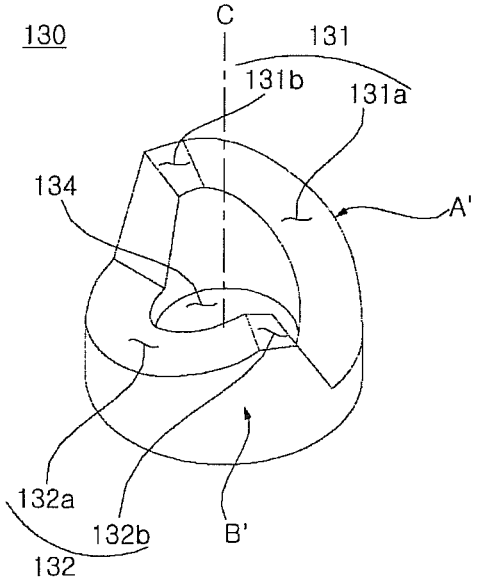
FIG. 4D is a view of a moving cam.
Figure 5A:
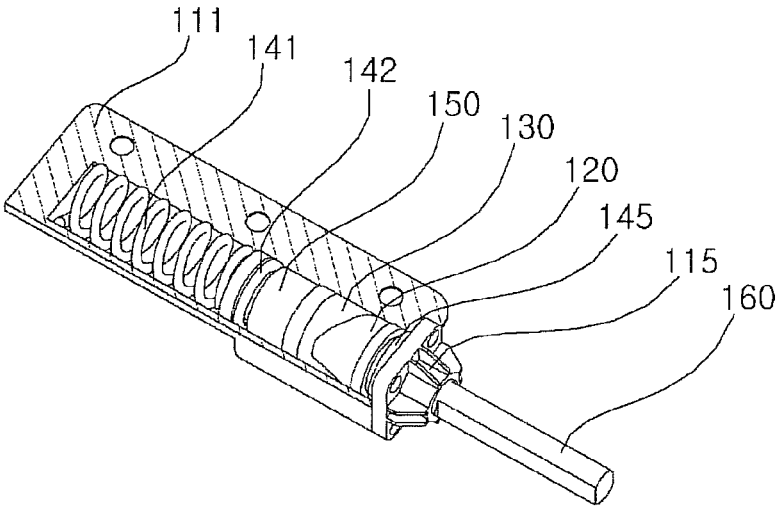
FIG. 5A is a view illustrating an internal configuration of a hinge part in a state where a lid is opened.
Figure 5B:
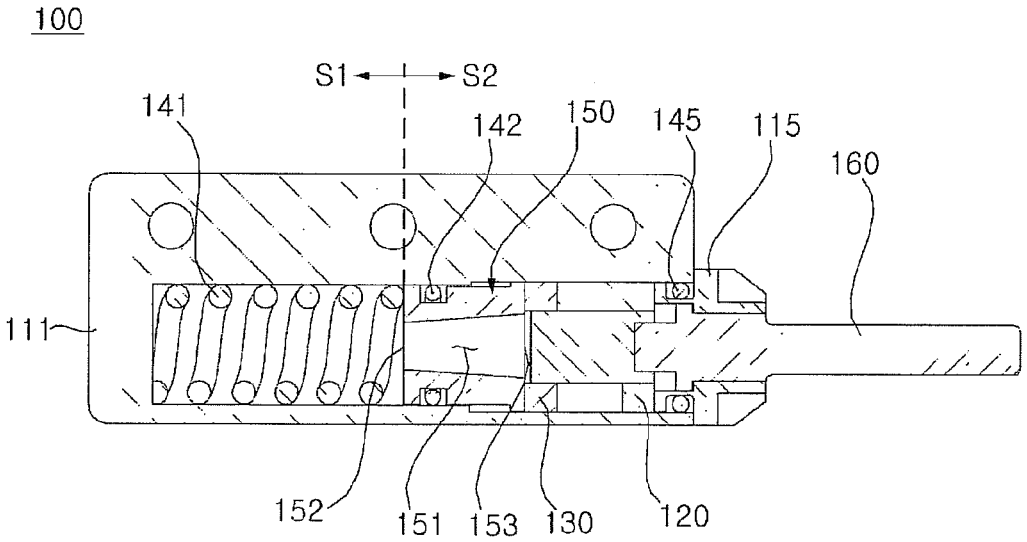
FIG. 5B is a cross-sectional view of FIG. 5A.
Figure 6A:
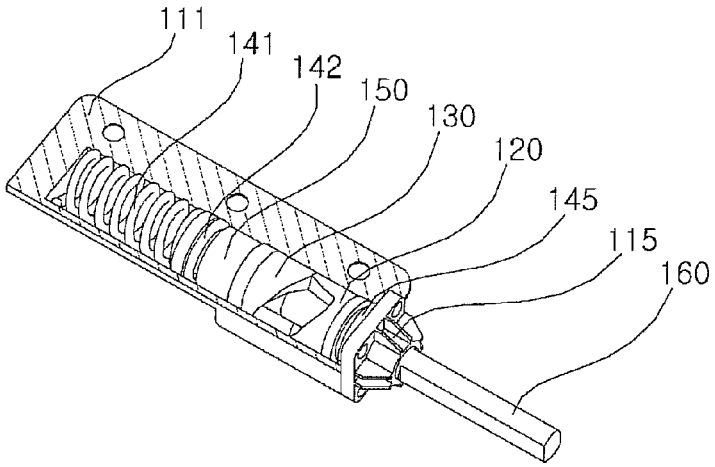
FIG. 6A is a view illustrating an internal configuration of a hinge part in a process where a lid is pivotably closed.
Figure 6B:
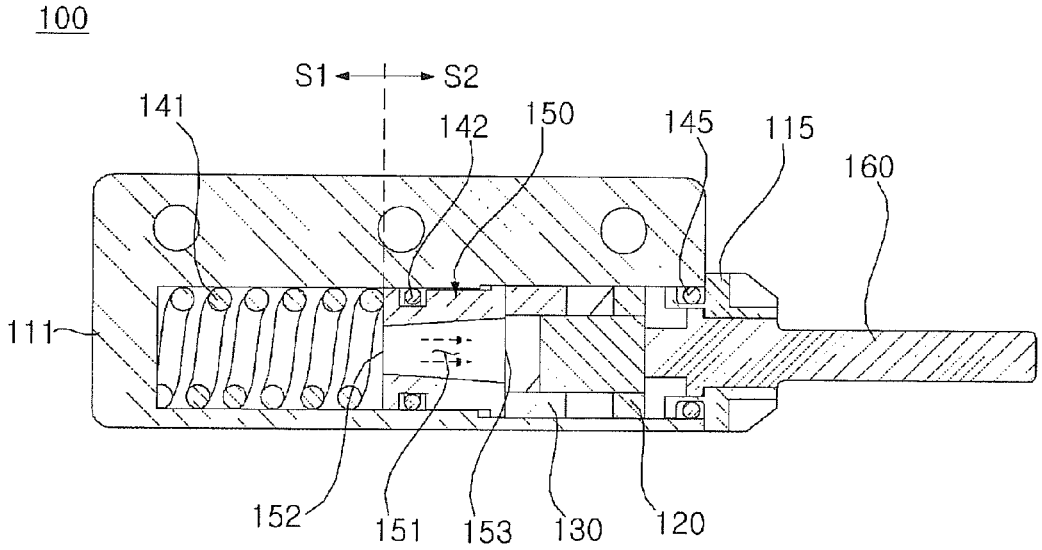
FIG. 6B is a cross-sectional view of FIG. 6A.

FIG. 4A is a perspective view of a hinge part, FIG. 4B is an exploded perspective view of the hinge part, FIG. 4C is a view of a fixing cam, and FIG. 4D is a view of a moving cam. FIG. 5A is a view illustrating an internal configuration of a hinge part in a state where a lid is opened, and FIG. 5B is a cross-sectional view of FIG. 5A. FIG. 6A is a view illustrating an internal configuration of a hinge part in a process where a lid is pivotably closed, and FIG. 6B is a cross-sectional view of FIG. 6A.

Referring to the foregoing drawings, a hinge part 100 may support the lid 20 such that the lid 20 can pivot about the main body 10. The hinge part 100 may include a hinge housing 110 filled with a fluid having a certain viscosity, an elastic member 141 disposed in the hinge housing 110, and a pair of cams 120 and 130.

At least one of the pair of cams 120 and 130 may include a contact surface formed so as to have a height difference along a circumferential direction. One of cams 120 and 130 may rotate in linkage with the lid 20, and the other cam may be maintained in contact with the rotating cam. Accordingly, one cam may move along its own center of rotation C (or pivoting line of the lid 20) according to the shape of the contact surface formed on at least one of two cams.

The cam refers to a device that transforms rotary motion into reciprocating motion or vice-versa. Generally, in the cam device, as a rotary cam in which a distance from a certain point on the circumference to the axis of rotation is not uniform rotates, a contacted cam follower of the circumference of the rotary cam moves in an orthogonal direction to the axis of rotation of the rotary cam, but transformation into reciprocating motion according to the axis of rotation of the rotary cam is possible according to the shape or the structure of the cam and the cam follower.

In this embodiment, the pair of cams may include a first cam rotating in linkage with the lid 20 and a second cam disposed in contact with the rotary cam to vary in relative distance from the first cam according to the rotation of the first cam. That is, when one (first cam) of two cams rotates in linkage with the lid 20, the contact surface of one cam (first cam) may slide along the contact surface of the other cam (second cam), and any one of two cams may move. Here, "one of two cams" may become the first cam or the second cam according to embodiments.

More specifically, according to the definition of the foregoing cams, the first cam may be defined as a rotary cam rotating relative to the lid 20 in mechanical linkage with the lid 20, and the second cam may be defined as a cam follower reciprocating by the first cam. However, it should be noted that in the defining of the hinge part, when the first cam rotates, the second cam need not necessarily reciprocate. According to embodiments, the first cam (see 130 of FIG. 4B) may reciprocate at the same time when rotating in linkage with the lid 20.

Also, the contact surface of the first cam and the contact surface of the second cam which contact each other need not necessarily have the same shape. That is, it is sufficient that a contact surface varying in height (e.g., inclined contact surface) according to the circumferential direction is formed on at least one of the first and second cams. Here, the height of the contact surface may be defined as a distance from a certain plane orthogonal to the axis of rotation of the cam to any point on the contact surface.

The hinge housing 110 may include a housing body 111 having one end opened and a housing cover 115 closing the opened one end of the housing body 111. A support plate 112 may be formed on the housing body 111, and a plurality of coupling holes 113 may be formed in the support plate 112 to receive coupling members 144 for coupling the hinge part 110 to the top cover 12. The housing cover 115 may have a through hole that a shaft 160 penetrates, and may be coupled to the housing body 111 by the coupling members 144.

Referring to FIG. 3, the hinge part 100 may be disposed in pair. The center of rotation or the shaft 160 of the pair of hinge parts 100 may be aligned on the same axis, and may be symmetrically disposed at the rear end of the lid 20. A receiving part 21*a* may be recessed at both sides of the rear end of the lid frame 21 to receive the hinge part 100, and a certain space 21*b* may be further formed around the end portion of the shaft 160 to receive a member (not shown) coupled with the shaft 160. Although not shown, a frame member may be further provided to be coupled to a lower side of the lid frame 21 such that the lid window 22 is not separated and the internal configuration of the lid frame 21, particularly, the hinge part 10 is not exposed to the outside.

The lid 20 may be supported by one pair of hinge parts 100, and each of hinge parts 100 may be configured in the same manner. Thus, since damping forces or supporting forces supported by each hinge part 100 are the same, a deformation such as distortion can be prevented even though the opening/closing of the lid 20 is repeated.

Meanwhile, a piston or a division member 150 may be disposed between the elastic member 141 and one of the pair of cams moving along the axial direction during the rotation of the lid 20, deforming the elastic member 141 in response to the displacement of the moving cam, and may divide the inside of the hinge housing 110 into a first space S1 in which the elastic member 141 is disposed and a second space S2 in which the pair of cams 120 and 130 is disposed (see FIGS. 5B and 6B). A fluid passage 151 may be formed in the division member 150 such that a fluid can move between the first space S1 and the second space S2. Accordingly, when the length of the elastic member 141 varies according to the movement of the cam and thus the first space 51 and the second space S2 is reduced or extended, a fluid may move between the first space S1 and the second space S2 in response thereto (see arrow of FIG. 6B). In this case, due to a viscous force according to the movement of the fluid, a certain damping force may be provided during the operation of the lid 20.

The hinge part 100 may include a hinge housing 110 filled with a fluid having a certain viscosity, an elastic member 141 disposed in the hinge housing 110, and a pair of cams 120 and 130 having contact surfaces 121, 122, 131, and 132 with height differences along the circumferential direction. The shaft 160 may connect the hinge part 100 to the top cover 12, and may be a fixed axis to which its own rotation is restricted. A culling surface 161 (also referred to herein as a cut surface or flat surface) may be formed along the outer circumferential surface of the round bar, and a fixing member such as a bracket having an insertion hole corresponding to the sectional shape of the shaft 160 may be provided to the top cover 12.

The pair of cams 120 and 130 may include a fixing cam 120 fixedly coupled to the shaft 160 to be restricted in its own rotation, and a moving cam 130 rotating in linkage with the lid 20 and varying in distance from the fixing cam 120 according to the rotation angle thereof. For example, the fixing cam 120 may be rotationally fixed relative to the lid and the moving cam 130 may be rotationally fixed relative to the hinge housing to move laterally within the hinge housing. The contact surfaces 121 and 122 of the fixing cam 120 and the contact surfaces 131 and 132 of the moving cam 130 may be mutually in contact with each other. Accordingly, the contact surfaces 121 and 122 of the fixing cam 120 may slide along the contact surfaces 131 and 132 of the moving cam 130 during the pivoting of the lid 20, and the location of the moving cam 130 may vary with the shapes of the contact surfaces, particularly, the height differences of the contact surfaces.

The contact surface (e.g., 131) of the cam may have a slope varying in height along the circumferential direction based on the central axis C (see FIG. 4D). In this case, the slope direction of the contact surface may be determined such that the moving cam 130 can move in a direction of compressing the elastic member 141 when the lid 20 pivots to close the laundry loading hole h. In this case, the division member 150 may compress the elastic member 141 while moving according to the displacement of the moving cam 130. In this structure, a restoring force by the compressed elastic member 141 may generate a torque in a direction where the lid 20 is opened by an interaction between the contact surfaces of the moving cam 130 and the fixing cam 120, and thus the closing speed of the lid 20 may be decelerated. That is, the torque may serve such that a user can open the lid 20 only with a weak force.

The fluid passage 151 may have a first hole 152 opened toward the first space S1 and a second hole 153 opened toward the second space S2. The sectional areas of the first and second holes 152 and 153 may be different from each other. This structure may enable differences of viscosity according to the movement of the fluid when the lid 20 is closed and opened. Particularly, the area of the first hole 132 may be formed to be smaller than that of the second hole 153 such that when the lid 20 is closed, a larger damping force can be provided than when the lid 20 is opened. In this case, the fluid passage 151 may be formed to have an increasingly large inner diameter from the first hole 152 to the second hole 153.

Comparing FIG. 6B with FIG. 5B, when the division member 150 is moved by the closing operation of the lid 20 to compress the elastic member 141, the first space S1 may be reduced whereas the second space S2 may be extended. Accordingly, the fluid inside the hinge housing 110 may move from the first space S1 to the second space S2, providing a certain damping force.

The hinge part 100 may further include an O-ring 142 that may provide an airtight seal between the outer circumferential surface of the division member 150 and the inner circumferential surface of the hinge housing 110 and an O-ring 145 that may provide an airtight seal between the housing body 111 and the housing cover 115.

Referring to FIG. 4C, the fixing cam 120 may include a first cam leg A and a second cam leg B. The first cam leg A and the second cam leg B may engage with a first cam leg A' and a second cam leg B' of the moving cam 130. The first cam leg A and the second cam leg B may have a ring-shaped partition structure varying in height of the end portion thereof along the circumferential direction, respectively, and the contact surfaces 121 and 122 may be formed on the end portion of the cam legs A and B, respectively.

In this case, the contact surfaces formed on at least one of the first and second cam legs A and B may have a normal inclination surface and a reverse inclination surface that extend to both sides at different inclination angles based on the peak point.

More specifically, the contact surface 121 of the first cam leg A may have a normal inclination surface 121*a* corresponding to a B-D section (see FIG. 7) between the pivoting angles d1 and d3 of the lid 20 and a reverse inclination surface 121*b* corresponding to an A-B section between the pivoting angles 0 (closed state of lid 20) and d1 of the lid 20. Similarly, the contact surface 122 of the second cam leg B may have a normal inclination surface 122*a* and a reverse inclination surface 122*b*.

Also, the fixing cam 120 may further include an insertion protrusion 123 protruding to the moving cam 130. The insertion protrusion 123 may be inserted into an insertion hole 134 (see FIG. 4D) formed in the moving cam 130, guiding the movement of the moving cam 130. In the displacement section where the location of the moving cam 130 varies according to the operation of the lid 20, the insertion protrusion 123 may be continuously maintained in a state of being inserted into the insertion hole 134.

Referring to FIG. 4D, the moving cam 130 may include the first cam leg A' and the second cam leg B' similarly to the fixing cam 120. The first cam leg A' and the second cam leg B' may have contact surfaces that contact the contact surfaces of the fixing cam, respectively.

The contact surface 131 formed on the first cam leg A' of the moving cam 130 may correspond to the contact surface 121 formed on the first cam leg A of the fixing cam 120. The contact surface 132 formed on the second cam leg B' of the moving cam 130 may correspond to the contact surface 122 formed on the second cam leg B of the fixing cam 120. During the pivoting of the lid 20, the contact surfaces 131 and 132 of the moving cam 130 may slide along the contact surfaces 121 and 122 of the fixing cam 120 corresponding thereto, respectively.

Meanwhile, similarly to the fixing cam 120, the contact surface 131 of the first cam leg A' may include a normal inclination surface 131*a* and a reverse inclination surface 131*b*, and the contact surface 132 of the second cam leg B' may include a normal inclination surface 132*a* and a reverse inclination surface 132*b*.

The normal inclination surfaces 131*a* and 132*a* of the moving cam 130 may slide along the normal inclination surfaces 121*a* and 122*a* of the fixing cam 120 within a rotation angle B-D of the lid 20, respectively.

The reverse inclination surfaces 131*b* and 132*b* of the moving cam 130 may slide along the reverse inclination surfaces 121*b* and 122*b* of the fixing cam 120 within a rotation angle A-B of the lid 20, respectively.

Figure 7:
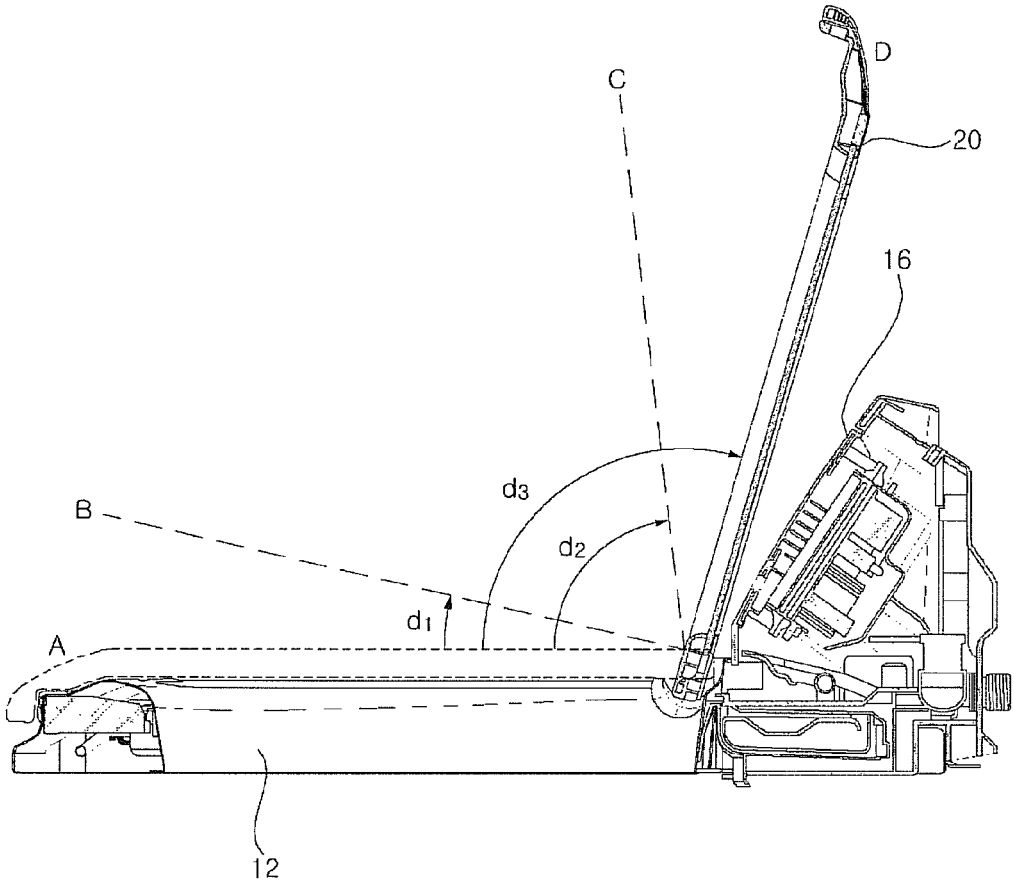
FIG. 7 is a side view illustrating a pivoting movement of a lid.

FIG. 7 is a side view illustrating a pivoting movement of a lid. Referring to FIG. 7, when a pivoting angle of the lid 20 from the closed location A to the maximally opened location D is defined as an opening angle, the lid 20 may automatically pivot from a point C where the opening angle is d2 to a point D without an additional external force by a user during the opening of the lid 20. When the lid 20 is opened only by an external force of a user, the lid 20 may be automatically opened from a point where the opening angle is about 90 degrees or more. However, in this embodiment, since a torque is exerted by the hinge part 100 in a direction where the lid 20 is opened, the lid 20 may be automatically opened even in a section (d2<90) where the opening angle is less than about 90 degrees. The opening angle d2 may be set to be about 80 degrees.

The maximum opening angle d3 of the lid 20 may be set to be about 110 degrees. In one embodiment, a stopper (not shown) may be further provided such that the lid 20 does not pivot beyond the maximum opening angle. Alternatively, the pivoting of the lid 20 may be limited by the contact with the control panel 16.

The pivoting of the lid 20 may be decelerated or stopped in a section between the opening angles d1 and d2. The direction of the torque applied by the hinge part 100 may be opposite to that of a torque by the self-weight of the lid 20. In addition, when considering the viscous force according to the movement of the fluid, it is apparent that the pivoting speed of the lid 20 is decelerated in the above section. Furthermore, since the torque acting by the hinge part 100 and the viscous force due to the movement of the fluid inside the hinge housing 110 serve as factors that offsets the torque by the self-weight of the lid 20, the lid 20 may also be maintained in a still state in the section between the opening angles d1 and d2 by an appropriate combination of the foregoing factors. As the capacity of the washing machine increases, the size of the lid 20 may also increase, making it difficult for a user to grip the front end of the lid 20 and then lift the lid 20 to the point C. Accordingly, when the pivoting of the lid 20 is stopped at a certain section within user's reach, convenience in use can be improved when laundry is loaded and unloaded.

Meanwhile, when the lid 20 reaches a section where the opening angle is less than d1 during the closing of the lid 20, the lid 20 may be automatically closed. In this section, the torque by the self-weight of the lid 20 may be stronger that those of other sections. Accordingly, when the shape of the contact surface, the elastic modulus of the elastic member 141, and the viscous force of the fluid are controlled, the lid 20 may be allowed to be automatically closed.

However, in addition, in at least one of the fixing cam 120 and the moving cam 130, the cam leg (hereinafter, cam leg A' of the moving cam 130) may include the first contact surface 131*a* allowing a torque to be exerted in a direction where the lid 20 is opened and the second contact surface 131*b* inclining to the opposite direction to the first contact surface 131*a*. Thus, the moving cam 130 and the fixing cam 120 may contact each other via the first contact surface 131*a* between the points B and D, and may contact each other via the second contact surface 131*b* between the points A and B. As described above, the contact surfaces formed on each cam may contact each other, by forming the contact surfaces 121*a* and 121*b* corresponding to the contact surfaces 131*a* and 131*b* of the moving cam 130 on the fixing cam 120 as well. The opening angle d1 of the point A may be set to be about 25 degrees.

Figure 8:
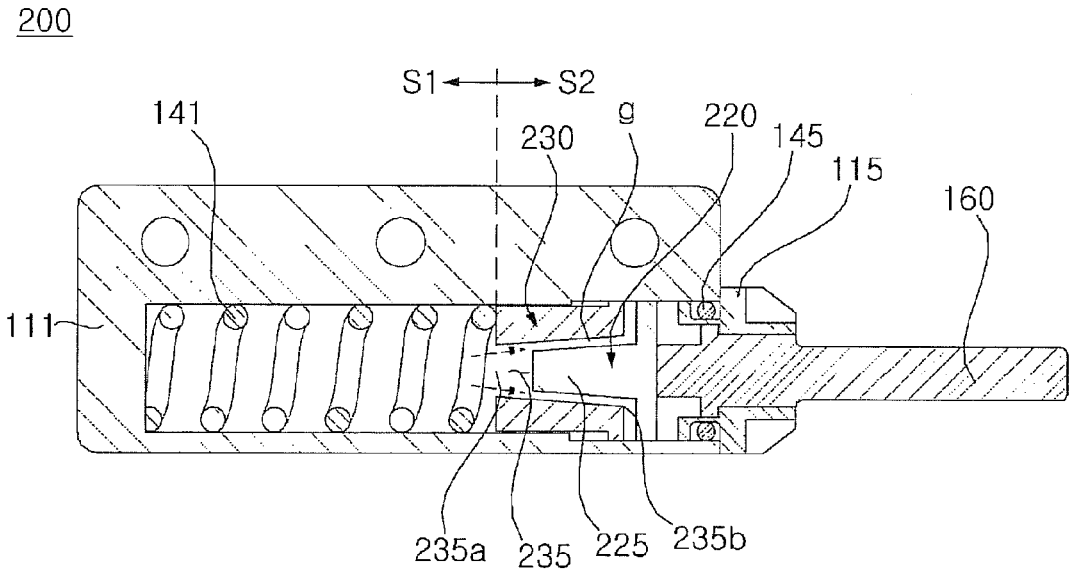
FIG. 8 is a cross-sectional view illustrating a hinge part according to another embodiment of the present disclosure.

FIG. 8 is a cross-sectional view illustrating a hinge part according to another embodiment of the present disclosure. Hereinafter, a hinge part 200 may be similar to the hinge part 100 described in the previous embodiment except that the division member 150 is omitted and the moving cam 230 and the fixing cam 220 have different structures.

In this embodiment, the hinge part 200 may have a fluid passage 235 in a moving cam 230 while the division member (see 150 of FIGS. 5A and 5B) is omitted, and the fixing cam 220 may include an insertion protrusion 225 that is inserted into the fluid passage 235. A gap g may exist between the fluid passage 235 and the insertion protrusion 225 for the movement of the fluid.

The fluid passage 235 may be formed such that the area of a second hole 235*b* opened toward the second space S2 is larger than the area of a first hole 235*a* opened toward the first space S1.

When the moving cam 230 moves to the elastic member 141 according to the closing pivoting of the lid 20, the elastic member may be deformed. In this case, a fluid may flow from the first space S1 to the second space S2 through the gap g between the inner circumferential surface of the fluid passage 235 and the outer circumferential surface of the insertion protrusion 225 (see arrow of FIG. 8).

The laundry treatment machine according to the embodiment of the present disclosure has an effect of stably supporting the pivoting of the lid, by generating a torque such that the closing speed of a lid is reduced due to deformation of an elastic member during the closing pivoting of the lid and allowing a viscous force to together act according to the movement of a fluid.

Also, the laundry treatment machine according to the embodiment of the present disclosure has an effect of exerting a uniform supporting force from two hinge parts supporting both sides of the lid.

The laundry treatment machine according to the embodiment of the present disclosure can reduce the size of an elastic member for the same supporting force and thus can miniaturize a hinge part supporting a lid, by providing the hinge part exerting a viscous force in addition to an elastic force, compared to a typical hinge structure that provides a supporting force only by an elastic force.

Figure 9:
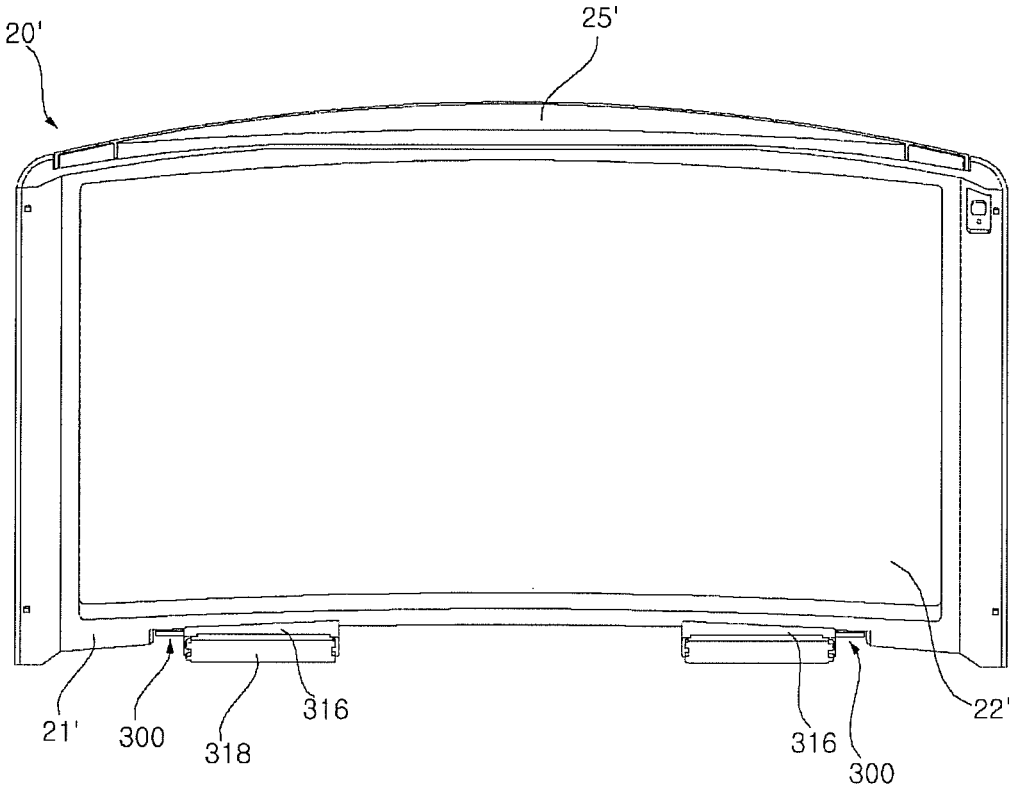
FIG. 9 is a view illustrating a lid according to still another embodiment of the present disclosure.
Figure 10:
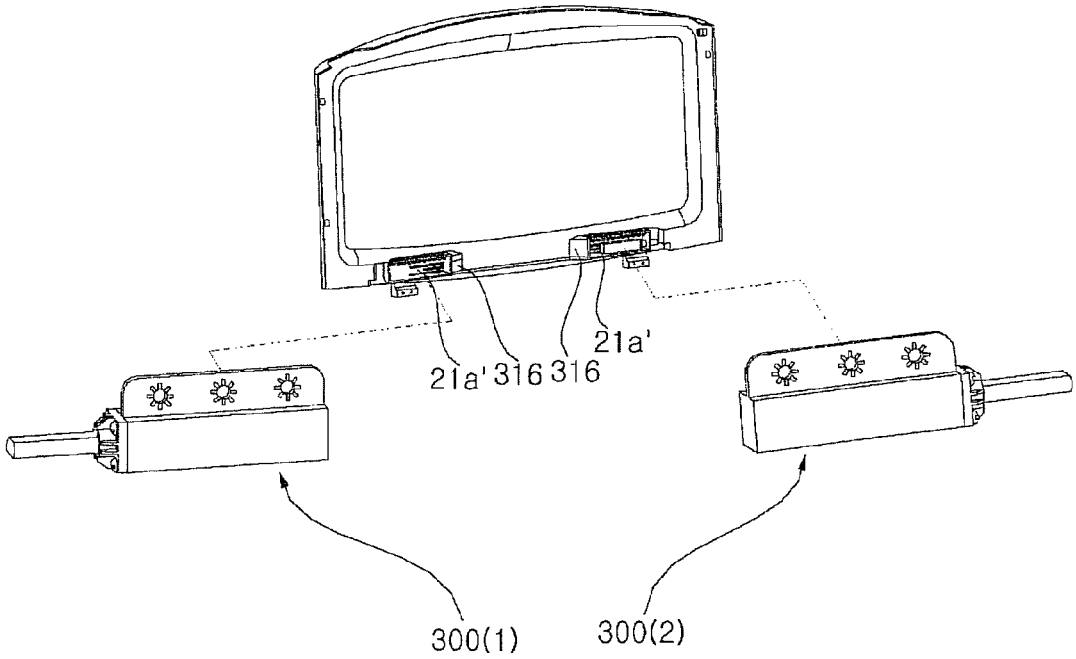
FIG. 10 is an exploded perspective view illustrating a lid and a hinge part shown in FIG. 9.

FIG. 9 is a view illustrating a lid according to still another embodiment of the present disclosure. FIG. 10 is an exploded perspective view illustrating a lid and a hinge part shown in FIG. 9.

Referring to FIGS. 9 and 10, the lid 20' may include a lid frame 21', a lid window 22' supported by the lid frame 21, and a handle 25' disposed at the front end of the lid frame 21'.

The lid 20' may be pivotably supported by a pair of hinge part 30. The pair of hinge parts 30 may include a first hinge part 300(1) and a second hinge part 300(2) that are disposed at left and right sides under the rear side of the lid 20' such that the first and second hinge parts 300(1) and 300(2) are spaced from each other by a certain distance. Since the hinge part 300 is disposed under the rear side of the lid 20', the hinge part 300 is less exposed to the outside than disposed at the side surface of the lid 20'.

A hinge mounting part 316 in which the hinge part 300 is mounted may be disposed under the lid frame 21', and may downwardly protrude from the lid frame 21'. The hinge mounting part 316 may include a receiving part **21*a*' formed to receive the hinge part 300**.

A shaft 360 may connect the hinge part 300 to the top cover 12, and may be a fixed axis to which its own rotation is restricted. A cutting surface 361 may be formed along the outer circumferential surface of the round bar, and a fixing member such as a bracket having an insertion hole corresponding to the sectional shape of the shaft 360 may be provided to the top cover 12.

Since the hinge mounting part 316 downwardly protrudes from the undersurface of the lid frame 21' and thus the hinge part 300 is located at a lower side, the shaft 360 may be coupled to the top cover 12. Also, in a typical structure in which the hinge part is inserted into the lid frame, the size of the hinge part needs to increase to a certain size or more for coupling with the top cover located at a lower side. On the other hand, in this embodiment, since the hinge mounting part 316 downwardly protrudes from the lid frame 21', the hinge part 300 may be easily coupled to the top cover 12, enabling the size of the hinge part 300 to be reduced compared to a related art. A cover 218 may cover the lower portion of the hinge part 300.

The left and right hinge parts 300(1) and 300(2) may have the substantially same structure. The left and right hinge parts 300(1) and 300(2) may be symmetrically disposed, but may differ from each other in mounting location. Accordingly, the same rotary force may be provided to the left and right side of the lid 20', and the parts can be used in common. Also, the number of parts can be reduced, and it is easy to assemble.

11 is a perspective view illustrating the hinge part shown in FIG. 10. FIG. 12 is a cross-sectional view illustrating the hinge part shown in FIG. 11. FIG. 13 is an exploded perspective view illustrating the hinge part shown in FIG. 14.

Figure 11:
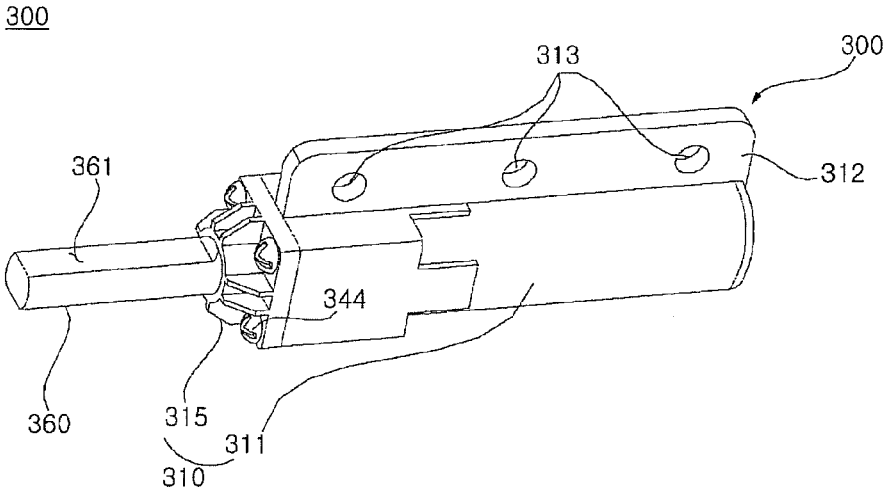
FIG. 11 is a perspective view illustrating the hinge part shown in FIG. 10.
Figure 12:
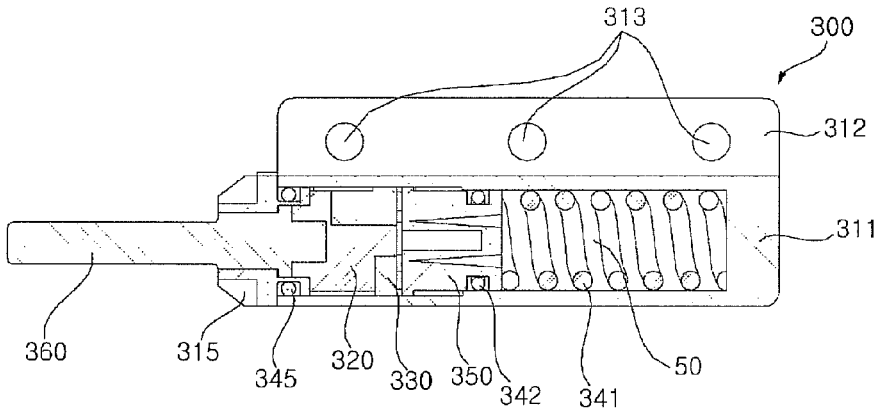
FIG. 12 is a cross-sectional view illustrating the hinge part shown in FIG. 11.
Figure 13:
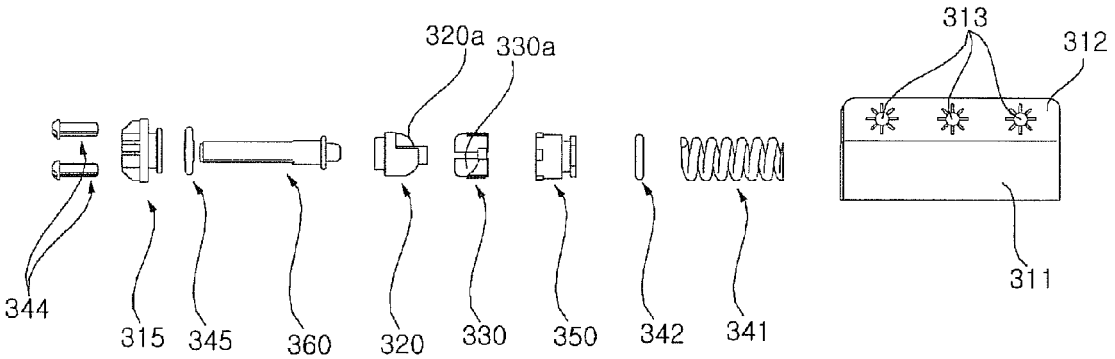
FIG. 13 is an exploded perspective view illustrating the hinge part shown in FIG. 12.

Referring to FIGS. 11 to 13, The hinge part 300 may include a shaft 360, a hinge housing 310, an elastic member 341, a pair of cams 320 and 330, a piston 350, and oil.

The hinge housing 310 may include a housing body 311 having one end opened and a housing cover 315 closing the opened one end of the housing body 311. The housing cover 315 may have a through hole that the shaft 360 penetrates. Hereinafter, the pair of cams 320 and 330 refers to a first cam 320 and a second cam 330, respectively. When one 330 the pair of cams 320 and 330 rotates in linkage with the lid 20', the contact surface of one cam 330 may slide along the contact surface of the other cam 320, and thus a distance between the two cams 320 and 330 may vary. The first cam 320 may be a fixing cam that is restricted in its rotation by the shaft 360. The second cam 330 may be a moving cam that rotates in linkage with the lid 20' and varies in distance from the first cam 320 according to the rotation angle thereof.

One end of the shaft 360 may be inserted into the hinge housing 310 to be coupled to the first cam 320, and the other end of the shaft 360 may be exposed to the outside of the hinge housing 310 to be fixedly coupled to the top cover 12.

The hinge housing 310 may have a cylindrical shape with one side opened, and may include an elastic member 341, a first cam 320, a second cam 330, a division member or a piston 350, and an oil. A support plate 312 may be formed on the outer circumferential surface of the hinge housing 310, and may be coupled to the lid 20' by a coupling member (not shown). The support plate 312 may have a plurality of coupling holes 313 which the coupling members are inserted into.

The support plate 312 may protrude from the center of one circumferential surface of the housing body 311, allowing the housing body 311 to be symmetrical in forward and backward directions. The housing body 311 may have a symmetrical shape in left-right and forward-backward directions, and thus may be installed at any location of the left and right sides of the lid 20'.

The housing cover 315 may block the opened plane of the housing body 311, and may be coupled by a coupling member 344. One end of the housing cover 315 may be inserted into the housing body 311, and an O-ring 345 that seals the housing body 311 and the housing cover 315 may be disposed between the insertion part of the housing cover 315 and the housing body 311 to prevent oil from leaking out of the housing body 311.

At least one of the first and second cams 320 and 330 may include a contact surface formed so as to have a height difference along a circumferential direction. The second cam 330 may rotate in linkage with the lid 20' and in this case, the first cam 320 and the second cam 330 may be maintained in contact with each other. Accordingly, one cam 330 may move along its own center of rotation (or axial line of rotation) according to the shape of the contact surface formed on at least one of both cams 320 and 330.

Similarly to the foregoing embodiment, an inclination surface **320*a* of the first cam 320 may have a normal inclination surface and a reverse inclination surface, and an inclination surface 330*a* of the second cam 330 may also have a normal inclination surface and a reverse inclination surface that have shapes corresponding to the inclination 320*a***.

The second cam 330 may rotate together with the pivoting of the lid 20', and at this point, the contact surface **330*a* of the second cam 330 and the contact surface 320*a* of the first cam 320 may interact. Thus, the second cam 330 may perform a linear motion, allowing the piston 350** to move.

The elastic member 341 may be deformed according to the movement of the piston 350. One end of the elastic member 341 may be coupled to the piston 350, and the other end thereof may be coupled to the housing body 311. The internal space 50 of the housing body 311 in which the elastic member 341 is disposed may be filled with a fluid (e.g., oil) having a certain viscosity. The elastic member 341 may be compressed or extended during the straight-line reciprocating motion of the second cam 330 and the piston 350. The second cam 330 may interact with the first cam 320 while reacting against an elastic force by the elastic member 341. In this case, the elastic force may finally generate a torque in a direction where the lid 20' is opened.

Meanwhile, the piston 350 and oil may act as a resistance when the lid 20' is closed, serving as a damper that decelerates the closing speed of the lid 20'. This resistance may be mainly a frictional force when the piston 350 move in a fluid with a certain viscosity, and a reaction force acting from the fluid that is compressed according to the movement of the piston 350.

The piston 350 may include an O-ring 342 on the circumferential surface thereof. The O-ring may seal the piston 350 and the hinge housing 311 to prevent oil from leaking out of the hinge housing 311.

Hereinafter, the operation of the hinge part 300 according to an embodiment of the present disclosure configured as above will be described as follows.

First, when the lid 20' is closed from the opened state, the second cam 330 may rotate in linkage with the lid 20'. In this case, the second cam 330 may straightly move due to the interaction with the first cam 320. The piston 350 may also move in the movement direction of the second cam 330, and thus the elastic member 341 may be compressed.

The elastic force or the restoring force acting from the compressed elastic member 341 may exert a strong repulsive force between the first cam 320 and the second cam 330.

The piston 350 may together move in the movement direction of the second cam 330, and thus oil inside the housing body 311 may be compressed. The second cam 330 may interact with the first cam 320 while reacting against an elastic force by the elastic member 341. In this case, the elastic force may finally generate a torque in a direction where the lid 20' is opened. Accordingly, the closing speed of the lid' 20 may be decelerated, and an impact noise generated when the lid 20' hits the top cover 12 may be reduced.

Since the hinge part 300 is disposed at both left and right sides of the lid 20' to perform the same action, the same amount of resistance or damping force may act on both left and right sides of the lid 20'. Accordingly, a typical limitation in which the lid 20' is distorted due to a non-uniformed damping force acting on both sides of the lid 20' may not occur, and a phenomenon that one of the left and right sides of the lid 20' is lifted when the lid 20' is closed may be prevented.

Meanwhile, when the lid 20' is opened from the closed state, the second cam 330 may move in the opposite direction to that of closing of the lid 20'. Even in this case, since the elastic force provided by the elastic member 341 serves to generate a torque in a direction where the lid 20' is opened, a force necessary for a user to open the lid 20' can be reduced.

Also, since the same hinge part 300 is disposed at the left and right sides of the lid 20' and thus the same rotary force or damping force is provided to the left and right sides, the weight of the lid 20' may be uniformly applied to each hinge part 300. Accordingly, the deformation (e.g., distortion) of the lid 20' can be prevented, and the durability can be improved.

The present disclosure provides a laundry treatment machine, which can more stably support the pivoting of the lid, by generating a torque such that the closing speed of a lid is reduced due to deformation of an elastic member during the closing pivoting of the lid and allowing a viscous force to together act according to the movement of a fluid.

The present disclosure also provides a laundry treatment machine, in which a lid is uniformly supported by two hinge parts at both sides.

The present disclosure also provides a laundry treatment machine, which can reduce the size of an elastic member for the same supporting force and thus can miniaturize a hinge part supporting a lid, by providing the hinge part exerting a viscous force in addition to an elastic force, compared to a typical hinge structure that provides a supporting force by an elastic force.

According to an aspect of the present disclosure, there is provided a laundry treatment machine comprising: a main body having a laundry loading hole; a lid opening and closing the laundry loading hole; and at least one hinge part pivotably supporting the lid with respect to the main body, the hinge part comprising: a hinge housing filled with a fluid having a certain viscosity; an elastic member disposed inside the hinge housing; a pair of cams having contact surfaces having height differences along a circumferential direction, wherein when one of the pair of cams rotates in linkage with the lid, a contact surface of the one cam slides along a contact surface of the other cam, allowing the one of the pair of cams to move; and a division member disposed between the moving cam and the elastic member to deform the elastic member according to a displacement of the moving cam, dividing an inside of the hinge housing into a first space in which the elastic member is disposed and a second space in which the pair of cams are disposed, and having a fluid passage such that a fluid flows between the first space and the second space.

The hinge part may further include a shaft coupled to a cabinet, and the pair of cams may include: a fixing cam restricted in the rotation thereof by the shaft; and a moving cam rotating in linkage with the lid and varying in distance from the fixing cam according to the rotation angle thereof.

When the lid is pivotably closed, the moving cam may move in a direction where a length of the elastic member is reduced.

The fluid passage may have a first hole opened toward the first space and a second hole opened toward the second space, and sectional areas of the first and second holes may be different from each other.

The sectional area of the first hole may be smaller than the sectional area of the second hole.

The sectional area of the fluid passage may gradually increase from the first hole to the second hole.

Tin the hinge part may further include an O-ring that airtightly seals between an outer circumferential surface of the division member and an inner circumferential surface of the hinge housing.

The hinge part may be disposed in pair to allow centers of rotation of the hinge parts to be aligned on the same axis.

The lid may include a lid window through which a user views laundry loaded through the laundry loading hole.

According to another aspect of the present disclosure, there is provided a laundry treatment machine including: a main body having a laundry loading hole; a lid opening and closing the laundry loading hole; and at least one hinge part pivotably supporting the lid with respect to the main body, the hinge part comprising: a hinge housing filled with a fluid having a certain viscosity; an elastic member disposed inside the hinge housing; and a pair of cams having contact surfaces having height differences along a circumferential direction, wherein when one of the pair of cams rotates, a contact surface of the one cam slides along a contact surface of the other cam, allowing one of the pair of cams to move and thus allowing the elastic member to be deformed, and an internal space of the hinge housing, by the moving cam, is divided into a first space in which the elastic member is disposed and a second space in which the other cam is disposed, the moving cam having a fluid passage such that a fluid flows between the first space and the second space.

The other cam may include an insertion protrusion that is inserted into the fluid passage.

A certain gap may exist between the fluid passage and the insertion protrusion for movement of the fluid.

The fluid passage may have a first hole opened toward the first space and a second hole opened toward the second space, and a sectional area of the first hole may be smaller than a sectional area of the second hole.

The sectional area of the fluid passage may gradually increase from the first hole to the second hole.

The at least one hinge part may include: a left hinge part connecting a left side of the lid to the main body and a right hinge part connected a right side of the lid to the main body, and the left hinge part and the right hinge part may be symmetrically disposed on the lid.

The left hinge part and the right hinge part may be identical to each other.

The left hinge part and the right hinge part may provide the same damping force.

The pair of cams may include: a fixing cam independently of pivoting of the lid; and a rotary cam rotating in linkage with the lid, and the rotary cam moves in a straight-line direction due to an interaction between a contact surface of the fixing cam and a contact surface of the rotary cam.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment machine comprising:

a main body having an opening for loading laundry;

a lid provided over the opening to open and close the opening; and at least one hinge that supports the lid with respect to the main body, the hinge including a hinge housing filled with a fluid having a prescribed viscosity, an elastic member disposed inside the hinge housing, a pair of cams disposed in the housing, wherein at least one of the cams moves in linkage with the lid and the elastic member, wherein the cams include contact surfaces that are inclined relative to each other in an axial direction of the cams, and when a contact surface of one of the cams slides along a contact surface of the other cam, the at least one of the cams is moved in a linear direction, and a piston disposed between the moving cam and the elastic member to deform the elastic member according to a displacement of the moving cam, wherein the piston divides a cavity inside the hinge housing into a first space in which the elastic member is disposed and a second space in which the pair of cams are disposed, wherein a passage is formed inside the piston such that the fluid flows between the first space and the second space through the passage when the moving cam is moved in the linear direction.

2. The laundry treatment machine of claim 1, wherein the pair of cams includes a fixing cam fixed to a shaft coupled to the lid; and the moving cam that rotates relative to the fixing cam in linkage with the lid and moves in the linear direction a prescribed distance from the fixing cam according to a rotation angle of the moving cam.

3. The laundry treatment machine of claim 2, wherein when the lid is in a closed position, the moving cam moves in a direction that compresses the elastic member.

4. The laundry treatment machine of claim 2, wherein the passage includes a first hole opened toward the first space and a second hole opened toward the second space, sectional areas of the first and second holes being different from each other.

5. The laundry treatment machine of claim 4, wherein the sectional area of the first hole is smaller than the sectional area of the second hole.

6. The laundry treatment machine of claim 5, wherein the sectional area of the fluid passage gradually increases from the first hole to the second hole.

7. The laundry treatment machine of claim 1, wherein the hinge includes an O-ring that provides an airtight seal between an outer circumferential surface of the piston and an inner circumferential surface of the hinge housing.

8. The laundry treatment machine of claim 1, wherein the at least one hinge includes a first hinge and a second hinge, an axis of rotation of the first hinge being the same as an axis of rotation of the second hinge.

9. The laundry treatment machine of claim 8, wherein the lid includes a lid window through which laundry loaded through the opening in the main body is visible.

10. The laundry treatment machine of claim 1, wherein the at least one hinge includes a left hinge that connects a left side of the lid to the main body; and a right hinge that connects a right side of the lid to the main body, wherein the left hinge and the right hinge are symmetrically disposed on the lid.

11. The laundry treatment machine of claim 10, wherein the left hinge and the right hinge are identical to each other and provide the same damping force.

12. A laundry treatment machine comprising:

a main body having an opening for loading laundry;

a lid provided over the opening to open and close the opening; and at least one hinge that supports the lid with respect to the main body, the hinge including a hinge housing filled with a fluid having a prescribed viscosity, an elastic member disposed inside the hinge housing, and a pair of cams disposed in the housing, wherein at least one of the cams moves in linkage with the lid and the elastic member, wherein the cams include contact surfaces that are inclined relative to each other in an axial direction of the cams, and when a contact surface of a first one of the cams slides along a contact surface of a second one of the cams, the second cam is moved in a linear direction, wherein the second cam divides a cavity inside the hinge housing into a first space in which the elastic member is disposed and a second space in which the first cam is disposed, wherein a passage is formed inside the second cam such that the fluid flows between the first and the second space through the passage when the second cam is moved in the linear direction.

13. The laundry treatment machine of claim 12, wherein the first cam includes a protrusion configured to be inserted into the fluid passage.

14. The laundry treatment machine of claim 13, wherein a prescribed gap is provided between the fluid passage and the protrusion for movement of the fluid.

15. The laundry treatment machine of claim 14, wherein the fluid passage has a first hole opened toward the first space and a second hole opened toward the second space, a sectional area of the first hole being smaller than a sectional area of the second hole.

16. The laundry treatment machine of claim 15, wherein the sectional area of the fluid passage gradually increases from the first hole to the second hole.

17. The laundry treatment machine of claim 12, wherein the at least one hinge includes a left hinge that connects a left side of the lid to the main body; and a right hinge that connects a right side of the lid to the main body, wherein the left hinge and the right hinge are symmetrically disposed on the lid.

18. The laundry treatment machine of claim 17, wherein the left hinge and the right hinge are identical to each other.

19. The laundry treatment machine of claim 17, wherein the left hinge and the right hinge provide the same damping force.

20. The laundry treatment machine of claim 12, wherein the pair of cams includes a fixing cam that is fixed relative to the lid to rotate with the lid; and a rotary cam that is rotationally fixed to the housing, and wherein the rotary cam moves in a linear direction due to an interaction between a contact surface of the fixing cam and a contact surface of the rotary cam.

* * * * *